United States Patent [19]

Ito et al.

[11] Patent Number: 5,020,983

[45] Date of Patent: Jun. 4, 1991

[54] DIVISIBLE SLIP-CASTING MOLDS

[75] Inventors: Takeshi Ito, Nagoya; Kazushige Murata, Tokoname; Kuniyoshi Kohmura, Nagoya, all of Japan

[73] Assignee: Inax Corporation, Japan

[21] Appl. No.: 428,613

[22] Filed: Oct. 30, 1989

Related U.S. Application Data

[63] Continuation-in-part of Ser. No. 381,050, Jul. 17, 1988.

[30] Foreign Application Priority Data

Jul. 19, 1988 [JP] Japan ..... 63-95503[U]
Nov. 9, 1988 [JP] Japan ..... 63-146320[U]

[51] Int. Cl.[5] ..... B28B 1/26

[52] U.S. Cl. ..... 425/85; 249/113; 249/141; 264/87; 425/84

[58] Field of Search ..... 425/84, 85, 812; 264/86, 87, 302, 304; 249/113, 141

[56] References Cited

U.S. PATENT DOCUMENTS 3,156,751 11/1964 Valdes et al. ..... 264/87
3,286,974 11/1966 Dean et al. ..... 249/141
3,659,994 5/1972 Ehrlich ..... 264/87
3,993,727 11/1976 Skriletz et al. ..... 264/87
4,528,152 7/1985 Aoyama et al. ..... 264/87
4,591,472 5/1986 Gerster ..... 264/87
4,818,457 4/1989 Ito et al. ..... 249/141
4,867,662 9/1989 Shimahara et al. ..... 425/84
4,884,959 12/1989 Ito et al. ..... 425/84

FOREIGN PATENT DOCUMENTS 211653 2/1987 European Pat. Off. ..... 264/87

*Primary Examiner*—James C. Housel
*Attorney, Agent, or Firm*—Lerner, David, Littenberg, Krumholz & Montlik

[57] ABSTRACT

A divisible slip-casting mold has filter layers which incorporate a combination of different types of fluid-flow conduits to improve the mechanical strength of the mold while providing the filter layers with substantially uniform fluid-flow properties. The conduits include major portions of blind holes installed in straight lines and minor portions of porous ropes arranged in curved lines. The porous ropes are essentially installed in those portions of the filter layer having a mechanical strength which is inferior to the predominant portions of the filter layer, and the blind holes are essentially installed in the predominant portions of the filter layer. Thus, improved mechanical strength and substantially uniform fluid-flow properties are provided substantially throughout the filter layers of the mold.

17 Claims, 1 Drawing Sheet

DIVISIBLE SLIP-CASTING MOLDS

CROSS REFERENCE TO RELATED APPLICATIONS

This is a continuation-in-part application of U.S. application Ser. No. 381,050, filed July 17, 1989.

FIELD OF THE INVENTION

The present invention relates to a slip-casting mold and a method for producing the mold. More particularly, the present invention relates to improvements in a casting mold for molding green articles of sanitaryware, ceramicware and the like.

BACKGROUND OF THE INVENTION

It is well-known in the art to install fluid-flow conduits consisting of either porous ropes or blind holes, each by themselves, in the filter layers of a slip-casting mold. Even with these conduits, such filter layers have exhibited problems including non-uniform fluid-flow properties and poor mold strength. Heretofore, such problems have been considered unavoidable in the art. These problems and the improvements in casting molds in accordance with the present invention are explained in detail in the comparative example and working examples set forth in the present specification.

SUMMARY OF THE INVENTION

The present inventors have attempted to employ fluid-flow conduits consisting of an effective combination of both porous ropes and blind holes, and have unexpectedly found that the conventional problems can be eliminated by installing a specific combination of the porous ropes and blind holes in the filter layers of the mold.

Thus, in accordance with the present invention there is provided a mold for casting a slip into a desired shape which comprises a plurality of mold parts assembled together to define an enclosed mold cavity having shape corresponding to the desired shape, each of the plurality of mold parts including a porous body forming a filter layer for removing water from a volume of the slip in the mold cavity, a plurality of fluid-flow conduits disposed in the filter layer, and a housing member for retaining the porous body, the filter layer having a filter surface in communication with the mold cavity, first portions of the filter layer having a first mechanical strength sufficient to withstand repetitive casting cycles and second portions of the filter layer having a second mechanical strength less than the first mechanical strength, and the housing members defining a housing for the mold upon assembly of the plurality of mold parts; a fluid-flow duct for connecting the plurality of fluid-flow conduits with the exterior of the housing; and a slip supply duct communicating between a source of the slip and the mold housing; the plurality of fluid-flow conduits including a combination of porous ropes arranged in the second portions of the filter layer and blind holes extending from the housing into the first portions of the filter layer, wherein the combination of porous ropes and blind holes provide the filter layer with substantially uniform fluid-flow properties without reducing the second mechanical strength of the second portions of the filter layer.

The aforementioned divisible casting mold can be produced by the following method which includes the steps of: providing a model for forming a mold cavity having a desired shape; assembling a reinforcing cage about the model; attaching a plurality of porous ropes to the reinforcing cage to form a cage assembly; assembling a plurality of housing members around the cage assembly to form a housing having a void between the housing and the model; filling the void with porous material and solidifying the porous material to form a filter layer; and forming blind holes in the filter layer from the housing towards the mold cavity.

A mold having supporting layers disposed between the housing and the filter layers can similarly be produced from a divided housing by including the supporting layers inside of the divided housing when assembling same over the wire cage.

DETAILED DESCRIPTION OF THE PREFERRED EMBODIMENTS

In view of the relatively high cost of the materials used to form filter layers, and in order to reinforce such filter layers to prevent the deformation thereof, the slip casting mold of the present invention may preferably be formed with a supporting layer disposed between the filter layers and the housing. In other words, the mold comprises supporting layers installed between the air-tight housing for the mold and the filter layers.

The materials for forming the filter layers can be any material which can form a continuously porous solid layer, including porous synthetic resins and gypsum. In order to maximize the performance and durability of the mold, it is generally preferred that the filter layers comprise a continuously porous synthetic resin. In contrast, the supporting layer may be formed from a substantially non-porous solid material.

The housing may be formed from a rigid case or frame which supports the filter layer and, when present, the supporting layer. When the mold consists of a frame and a filter layer, the exposed portions of the filter layer are typically coated with an air-tight paint.

The porous ropes installed in the molds may include, for example, fibrous cords and fibrous tubes, fibrous tubes (e.g., knitted cotton tubes) normally being employed. The outer diameter of the porous ropes is generally in the range between about 2 mm to about 20 mm. The porous ropes are generally arranged along the filter layers at an interval of about 5 mm to 60 mm and at a depth of about 10 mm to 40 mm from the exposed surfaces of the filter layers.

The term "blind hole" as used herein refers to a long narrow hole installed from the housing towards the surfaces of the filter layers at intervals of about 10 mm to about 100 mm. The closed ends of the blind holes extend to a distance of about 10 mm to about 40 mm from the filter surface. The diameter of the blind hole is generally in the range of about 5 mm to about 30 mm. Moreover, the blind holes may contain some fillers such as fibers in order to store sufficient water therein for providing a water film upon demolding the molded article.

EXAMPLE I (Comparative)

Figure 2:
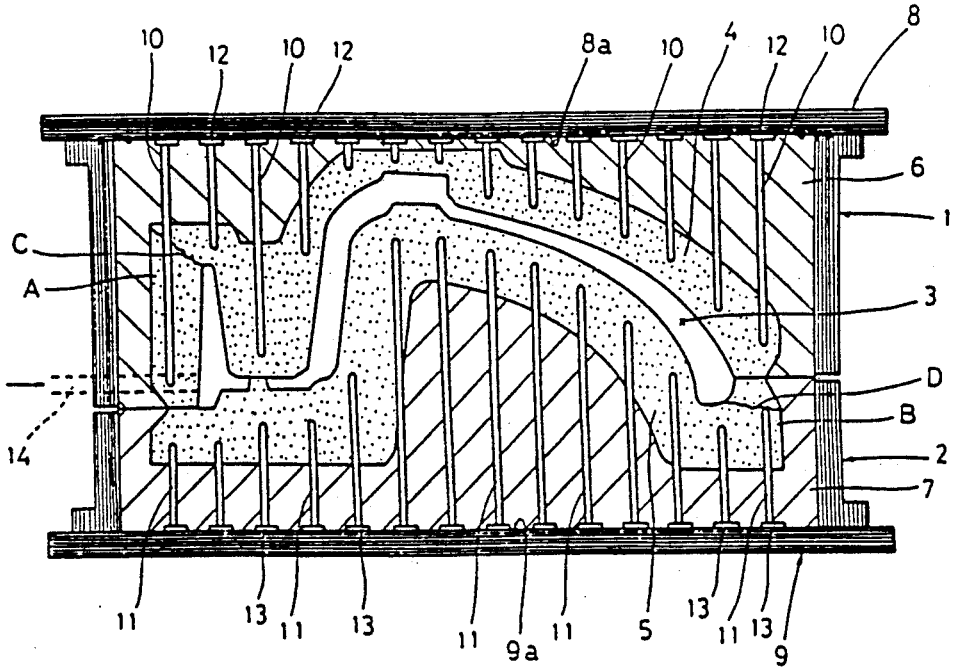
FIG. 2 ( PRIOR ART )
FIG. 2 is a vertical cross-sectional view of the prior art mold of comparative Example I.

For comparison, a conventional casting mold is shown in FIG. 2. This mold is a divisible casting mold having an upper mold portion 1 and a lower mold portion 2. Each mold portion includes a filter layer 4 or 5, respectively, formed from porous solid materials which form mold cavity 3 when mated together; a housing located outside of the filter layers; and, as necessary, supporting layers 6 and 7 formed from a non-porous material which supports the respective filter layers 4 and 5. Filter layers 4 and 5 and supporting layers 6 and 7 are supported by reinforcing frame members 8 and 9 which when mated together form the mold housing.

Reference numbers 10 represent parallel blind holes which are installed downwardly in upper mold portion 1. Similarly, reference numbers 11 represent parallel blind holes installed upwardly in lower mold portion 2. The closed ends of blind holes 10 extend within the filter layer 4, while the upper ends thereof are connected to crossing conduits 12 located between the lower surface 8*a* of the reinforcing frame 8 and the supporting layer 6, blind holes 10 communicating with one another via the conduits 12. Similarly, the closed ends of blind holes 11 extend within the filter layer 5, while the lower ends thereof are connected to crossing conduits 13 located between the upper surface 9*a* of the reinforcing frame 9 and the supporting layer 7, blind holes 11 communicating with one another via conduits 13. Both conduits 12 and 13 communicate with the outside of the mold via fluid-flow ducts which are not shown in the drawings.

The use of the mold of FIG. 2 for casting a slip is carried out in the following procedure. The mold cavity 3 is filled with slip supplied via the slip supply duct 14. The slip in the mold cavity is pressurized to drive water contained in the slip into the filter layers 4 and 5. As the slip is deposited onto the inner surfaces of the filter layers, the fluid-flow ducts may be depressurized to drain the water driven into the filter layers 4 and 5 via the blind holes 10 and 11, respectively. In the production of a hollow molded article, the slip supply duct 14 is set to a gravitationally low position when the deposited layer reaches a predetermined thickness, and the slip remaining in the mold cavity is drained therefrom via the slip supply duct 14.

The materials for forming filter layers 4 and have inherently poor mechanical strength, and the strength thereof is further reduced by the installation of blind holes 10 and 11 therein. Such molds typically develop defects in the form of cracks, such as indicated by the letters C and D in FIG. 2, which are generated upon the supply and pressurization of slip to the mold cavity. Thus, upon the supply and pressurization of the slip, concentrated stresses are developed at the weak portions of the filter layers. Such weak portions are typically those areas where the filter layers are relatively thin and in which the pressure is applied substantially from one side. An example of such portions are those portions identified as A and B in FIG. 2, which are thin, receive pressure from one side and are curved in an L shape. Molds having such cracked filter layers are undesirable. When the slip in the conventional mold of the present example was pressurized to 1.5 MPa, which pressure is a practical pressure used for molding, cracks of about 2 mm in width were generated after only five molding cycles.

EXAMPLE II

Figure 1:
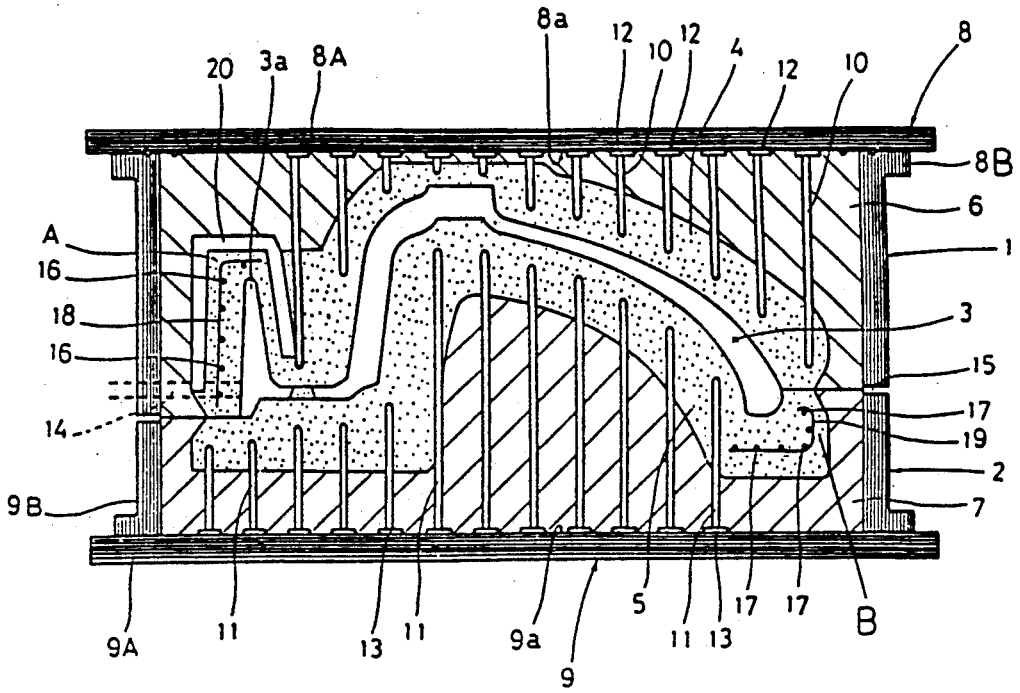
FIG. 1 is a vertical cross-sectional view of the mold of Example II.

FIG. 1 shows a cross-sectional view of a casting mold in accordance with the present invention, the structure of which is similar to that discussed above in connection with comparative Example I, shown in FIG. 2, the same reference numerals identifying the same elements.

The reinforcing frame or housing 8 consists essentially of a plate-like upper frame 8A which forms and upper surface of the mold and side frames 8B which cover a supporting layer 6. The interface between the lower surface 8*a* of upper frame 8A and the upper surface of the supporting layer (excluding the parts of the surface wherein crossing conduits 12 are located) may be sealed by a resin putty. The reinforcing frame 9 consists essentially of a plate-like lower frame 9A which forms the lower surface of the mold and side frames 9B which cover a supporting layer 7. The interface between the upper surface 9*a* of the lower frame 9A and the lower surface of the supporting layer 7 (excluding the parts of the surface wherein crossing conduits 13 are located) may also be sealed by means of a resin putty. The casting mold is designed to provide gaps 15 between the lower end of the side frame 8B of the reinforcing frame 8 and the upper end of the side frame 9B of the reinforcing frame 9 when the mold is closed as shown in FIG. 1. Thus, both the supporting layer 6 and filter layer 4 of the upper mold portion 1 and the supporting layer 7 and filter layer 5 of the lower mold portion 2 are intimately mated with each other without a gap. This mating interface may also be sealed by means of a resin putty when the mold is in a closed state. The supporting layer is not necessary to the operation of the mold, and the use of supporting layers may be avoided by merely replacing the supporting layers with additional amounts of filter layers.

In the mold of the present invention, as shown in FIG. 1, porous tubes 16—16 and 17—17 are installed in the weak portions of the filter layers, i.e., portion A of filter layer 4 and portion B of filter layer 5. (Such weak portions are empirically determined by the development of cracks during the slip-casting operation as discussed in connection with the conventional mold of the previous example.) The porous tubes 16—16 and 17—17 are made from air-permeable, water-permeable materials such as woven fabrics (e.g., cotton fabrics) or glass fibers, and form continuous tubular conduits running in a curved fashion throughout portions A and B, respectively. The tubular conduits consisting of porous tubes 16—16 and 17—17 are connected through supporting layers 6 and 7 and crossing conduits 12 and 13, respectively, to fluid-flow conduit's exterior of the mold to conduct supply and drainage actions in a fashion similar to that performed by blind holes 10 and 11 as discussed above. Supporting nets 18 and 19 support the porous tubes 16—16 and 17—17, respectively, and are embedded integrally in the corresponding filter layers 4 and 5 as these layers are formed.

A stainless steel bar 20 is provided along the backside of weak portion A (this part is long in vertical direction). The reinforcing bar 20 has an N-shaped configuration similar to the shape of a part 3*a* of casting cavity 3, and is generally installed at such a position between the supporting layer 6 and filter layer 4 that does not adversely affect the supply and drainage action of water through the filter layer.

In this example, porous tubes 16—16 and 17—17 serve to conduct the water which enters into filter layers 4 and 5 during deposition of the slip to the outside fluid-flow ducts, in much the same manner as blind holes 10 and 11. After deposition of the slip, an appropriate amount of water is supplied to the filter layer surfaces via the porous tubes 16—16 and 17—17 and the blind holes 10 and 11 by pressurizing theses fluid-flow conduits. This water exudes onto the surfaces of the filter layers 4 and 5 to form thin water films between the filter layers and the molded article to thereby facilitate the removal of the molded article from the mold cavity.

The installation of porous tubes 16—16 and 17—17, and the associated supporting nets 18 and 19, in portions A and B of the filter layers 4 and 5 increases the strength of portions A and B in comparison with the strength which results from the installation of blind holes 10 and 1! in these regions. This increase in strength enables cracking in these regions to be substantially prevented. Further improvements of strength and elimination of cracking is achieved by reinforcing the backside of portion A with stainless steel bar 20 as described above.

Although the porous tubes 16—16 and 17—17 have only been installed in those portions A and B of the mold which are mechanically weak, the present invention contemplates that such porous tubes may be employed in other portions of the filter layers where appropriate, for example, in those portions of the mold where the filter layer is too deep to readily install a blind hole.

In accordance with the present invention, porous ropes (e.g., porous tubes) may be successfully employed instead of blind holes in those portions of the filter layers of slip-casting molds where the mechanical strength is poor. Such portions include, for example, those portions of the filter layer which are relatively thin (i.e., thinner than other portions of the filter layer) and which receive slip pressure substantially from one side, such as portions A and B shown in FIGS. 1 and 2 and discussed in Examples I and II above. The installation of blind holes in such weak portions of the filter layers further decreases the mechanical strength thereof. Thus, the installation of porous ropes instead of blind holes results in improved mechanical strength. Moreover, the arrangement of the porous ropes along the filter layer frequently serves to reinforce such weak portions. As necessary, the weak portions can be further reinforced by embedding a supporting bar therein.

We claim:

1. A mold for casting a slip into a desired shape comprising, a plurality of mold parts assembled together to define an enclosed mold cavity having a shape corresponding to said desired shape, each of said plurality of mold parts including a porous body forming a filter layer for removing water from a volume of said slip in said mold cavity, a plurality of fluid-flow conduits disposed in said filter layer, and a housing member for retaining said porous body, said filter layer having a filter surface in communication with said mold cavity, the filter layer of at least one of said mold part having first and second portions, and said housing members defining a housing for said mold upon assembly of said plurality of mold parts, a fluid-flow duct for connecting said plurality of fluid-flow conduits with the exterior of said housing, and a slip supply duct communicating between a source of said slip and said mold cavity, said plurality of fluid-flow conduits including a combination of porous ropes arranged in said second portions of said filter layer and blind holes extending from said housing into said first portions of said filter layer, wherein said combination of porous ropes and blind holes provide said filter layer with substantially uniform fluid-flow properties without reducing said second mechanical strength of said second portions of said filter layer.

2. A mold as claimed in claim 1 wherein said porous ropes are arranged in curved patterns in said second portions of said filter layer and said blind holes extend in substantially straight lines from said housing into said first portions of said filter layer.

3. A mold as claimed in claim 1 wherein said filter layer is formed from a porous synthetic resin.

4. A mold as claimed in claim 1 wherein said blind holes extend from an open end at said housing to a closed end a predetermined distance from said filter surface, said predetermined distance being between about 10 mm and about 40 mm.

5. A mold as claimed in claim 1 wherein said porous ropes are operative to mechanically reinforce said second portions of said filter layer.

6. A mold as claimed in claim 1 further comprising a filler material disposed in said blind holes for storing water in said blind holes.

7. A mold as claimed in claim 1 further comprising a reinforcing member disposed in said second portions of said filter layer for mechanically reinforcing said second portions of said filter layer.

8. A mold as claimed in claim 7 wherein said reinforcing member is formed from stainless steel.

9. A mold as claimed in claim 1 wherein each of said plurality of mold parts further includes a supporting layer disposed between said filter layer and said housing.

10. A mold as claimed in claim 9 wherein said supporting layer is substantially non-porous.

11. A mold as claimed in claim 9 wherein said porous ropes are arranged in curved patterns in said second portions of said filter layer and said blind holes extend in substantially straight lines from said housing into said first portions of said filter layer.

12. A mold as claimed in claim 9 wherein said filter layer is formed from a porous synthetic resin.

13. A mold as claimed in claim 9 wherein said blind holes extend from an open end at said housing to a closed end a predetermined distance from said filter surface, said predetermined distance being between about 10 mm and about 40 mm.

14. A mold as claimed in claim 9 wherein said porous ropes are operative to mechanically reinforce said second portions of said filter layer.

15. A mold as claimed in claim 9 further comprising a filler material disposed in said blind holes for storing water in said blind, holes.

16. A mold as claimed in claim 9 further comprising a reinforcing member disposed in said second portions of said filter layer for mechanically reinforcing said second portions of said filter layer.

17. A mold as claimed in claim 16 wherein said reinforcing member is formed from stainless steel.

* * * * *

UNITED STATES PATENT AND TRADEMARK OFFICE

CERTIFICATE OF CORRECTION

PATENT NO. : 5,020,983

DATED : June 4, 1991

INVENTOR(S) : Ito et al.

It is certified that error appears in the above-identified patent and that said Letters Patent is hereby corrected as shown below:

On the title page, item[63] Related U.S. Application Data, "1988" should read --1989--.

Column 1, line 40 after "having" insert --a--.

Column 3, line 48 after "4 and" insert --5--.

Column 4, line 13 after "layer" insert --6--.

Column 5, line 16 "1!" should read --11--.

Column 5, line 60, "part" should read --parts--.

Column 6, line 10, after "reducing" delete --said second--.

Column 6, line 59 , after "blind" delete --,--.

Column 5, line 60, after "having" insert --a--.

Signed and Sealed this

Twenty-ninth Day of December, 1992

*Attest:*

DOUGLAS B. COMER

*Attesting Officer*

*Acting Commissioner of Patents and Trademarks*